42R-116 SR
9/15/86 OR 4,612,225

United States Patent [19]

Graffam et al.

[11] Patent Number: 4,612,225

[45] Date of Patent: Sep. 16, 1986

[54] STRUCTURAL PANEL

[75] Inventors: Don E. Graffam, Barrington; Lawrence L. Lezon, Lake Zurich; Arthur R. Slaters, Jr., Arlington Heights, all of Ill.

[73] Assignee: Signode Corporation, Glenview, Ill.

[21] Appl. No.: 753,702

[22] Filed: Jul. 10, 1985

[51] Int. Cl.[4] ..... B32B 3/26; B32B 27/00

[52] U.S. Cl. ..... 428/116; 264/164; 428/119; 428/188; 428/219

[58] Field of Search ..... 428/116, 119, 120, 131, 428/188, 219; 264/164

[56] References Cited

U.S. PATENT DOCUMENTS

| | | | |
|---|---|---|---|
| 3,707,009 | 12/1972 | Wagner | 428/188 |
| 3,919,380 | 11/1975 | Smarook et al. | 428/116 |
| 3,919,382 | 11/1975 | Smarook | 428/116 |
| 4,134,243 | 1/1979 | Fries | 428/116 |
| 4,137,354 | 1/1979 | Mayes, Jr. et al. | 428/116 |
| 4,172,916 | 10/1979 | Watson | 264/164 |

*Primary Examiner*—Paul J. Thibodeau

*Attorney, Agent, or Firm*—Dressler, Goldsmith, Shore, Sutker & Milnamow

[57] ABSTRACT

A unitary, structural panel of a thermoplastic material and a method of forming same are disclosed. The panel includes planiform webs that traverse the full thickness dimension of the panel and define a plurality of elongated, open channels that are substantially in axial alignment with one another. One or more layers of an expanded blank are pared to form the structural panel of the invention.

4 Claims, 3 Drawing Figures

Fig. 1.
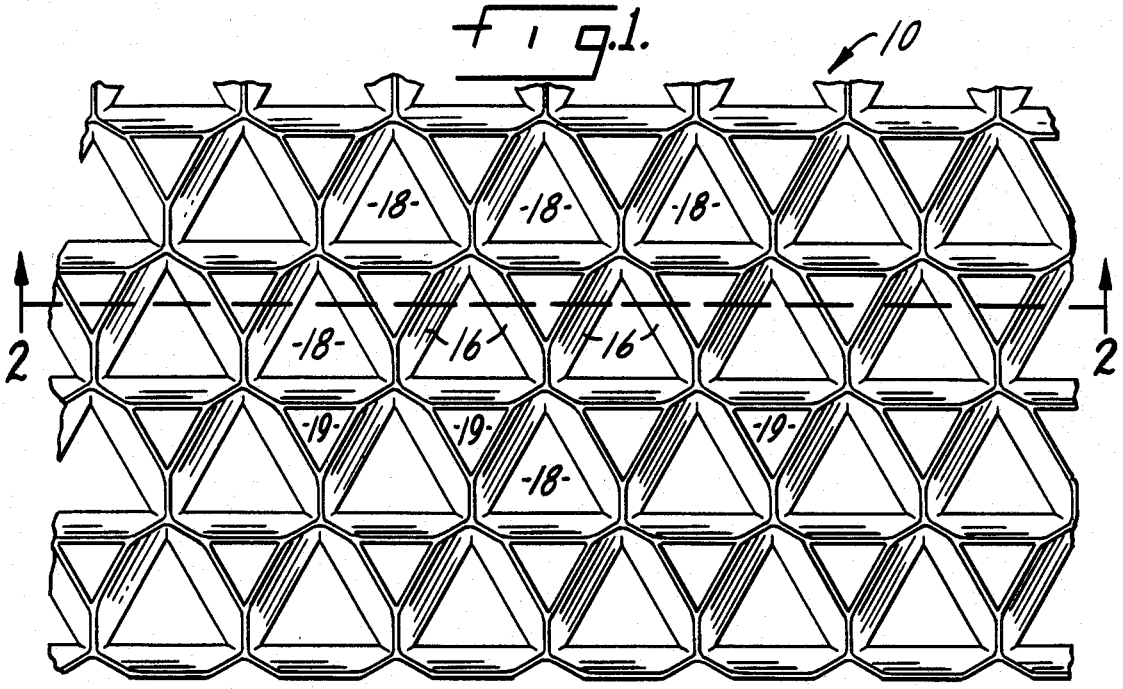
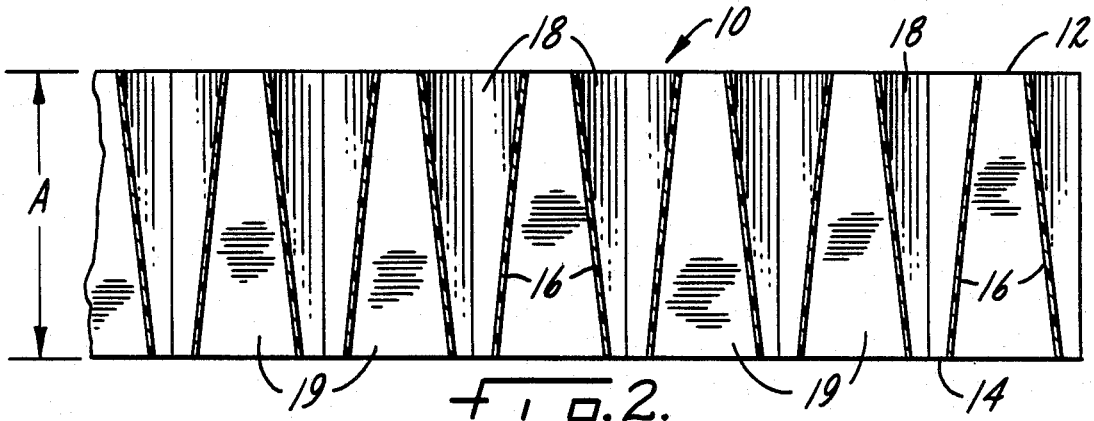
Fig. 2.
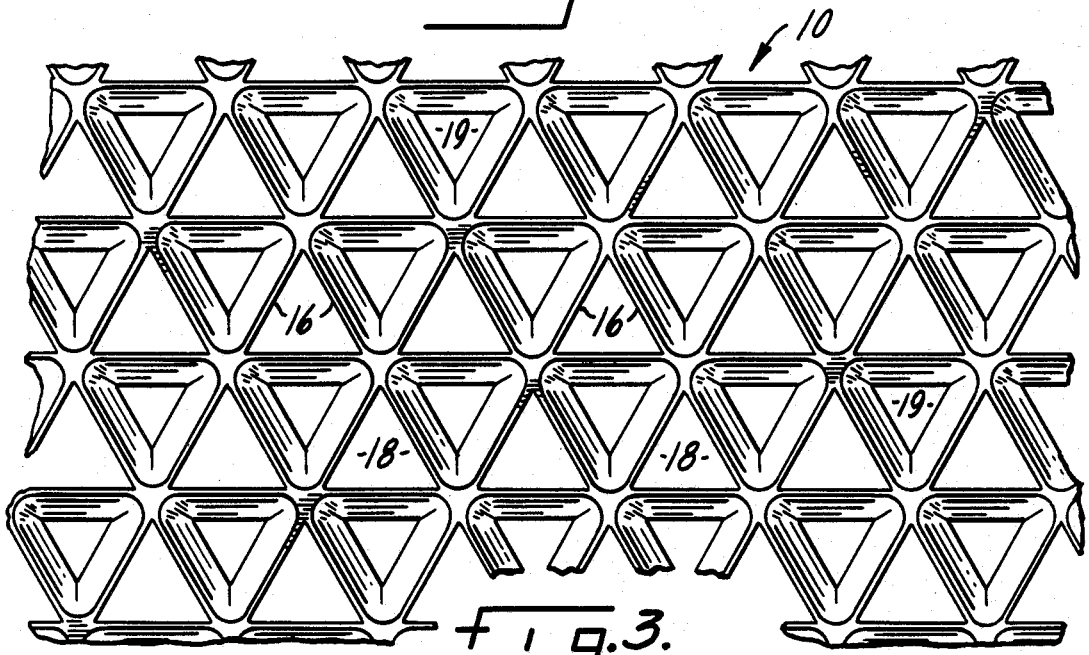
Fig. 3.

STRUCTURAL PANEL

TECHNICAL FIELD

The present invention relates to structural panels. More particularly, this invention relates to relatively lightweight, unitary structural panels made from a thermoplastic material.

BACKGROUND OF THE INVENTION

Structural panels are used for many applications, especially for use as core materials. For certain applications, it is desirable that the panel have both rigidity and structural strength and that it also be relatively lightweight. In an attempt to provide such panels, various techniques have been developed for providing a core of rigid material having a relatively low density sandwiched between skins of material that have relatively high densities.

In a series of patents granted to Walter Smarook and including U.S. Pat. Nos. 3,765,810, 3,919,378, 3,919,379, 3,919,380, 3,919,381, 3,919,382, 3,919,445, 3,919,446, 4,070,515, and 4,148,954, there is disclosed a process and apparatus for expanding a thermoformable material to form a panel. Specifically, a sheet of thermoformable material is disposed between two platens having a plurality of vented openings on the working surface thereof. The platens are heated to a temperature of at least 70° C. at which point the material becomes tacky and is bonded to the platen by hot tack adhesion. The platens are then moved apart expanding the material in such a manner that, at the locations of the vented openings, voids are formed in the material. The process disclosed in these patents is limited to relatively small panels. As defined in these patents, the term "thermoformable" means a material that is solid at 25° C. but can be reshaped or reformed above some higher temperature.

U.S. Pat. Nos. 4,113,909 and 4,164,389 describe a manner in which such a process can be applied to the formation of large sheets, e.g., 5 feet×10 feet sheets. Expanded panels can be made having voids on both sides, and also with one side having a continuous surface and the other containing voids.

U.S. Pat. No. 4,315,051 describes a process for producing a clear surface on expanded thermoformable material. A film layer of non-bondable plastic material is disposed adjacent the clear plastic material to be expanded. After the expansion process, the film layer is removed leaving a clear, smooth surface.

However, a major drawback attendant upon such structural panels, formed by the heretofore known processes and techniques, is that the panels have been expensive to produce due to the amount of resin material used in forming the panels so as to limit their commercial utility . As much as about 85 percent of the cost of forming the panels has been found to be attributable to material costs for making such panels, thereby rendering such panels less than competitive in many applications, as structural materials. Additionally, the presence of the relatively large amount of resin material affects adversely the weight of the panel itself. It can thus be seen that there is a substantial need for structural panels that can be formed at a relatively lower cost by using less material while maintaining sufficient strength and load-bearing capability without an attendant weight penalty.

SUMMARY OF THE INVENTION

The present invention contemplates a unitary, structural panel of a thermoplastic material made in one piece. The panel has width, length, and thickness dimensions and opposed, substantially parallel faces spaced from one another by the thickness dimension. Such faces may be weblike. The bulk density of the panel is lower than in heretofore known structural panels made from thermoplastic resins in accordance with the several patents mentioned hereinabove.

In one aspect of the present invention, the structural panel of the invention includes a framework of planiform webs that traverse the full thickness dimension of the panel and define a plurality of elongated, open channels that are substantially in axial alignment with one another. The panel has a bulk density of no more than about 1.1 kilograms per square meter per centimeter of thickness and a compressive strength in the thickness direction of at least about 7 kilograms per square centimeter.

In another aspect of the present invention, a method of forming the structural panels of the invention between a pair of perforated mold plates from a blank of thermoplastic material is contemplated. The cross-section of the blank of the material has a hot tack adhesion temperature so as to provide the material with an expanded cross-sectional geometry that comprises a plurality of elongated, open channels separated by expanded planiform webs of the material. The surface of each of the perforated mold plates has a non-perforated contacting surface area and the blank has two contacting surfaces. The method includes first positioning of the mold plates with respect to each other so that the perforations therein are not aligned. The blank is then positioned between the surfaces of the mold plates while it is heated to a temperature that is greater than or equal to the hot tack adhesion temperature. The mold plates and the blank are then brought into contact at their contacting surfaces while the blank is at a temperature of greater than or equal to the hot tack adhesion temperature so as to effect hot tack adhesion between the contacting surfaces. Subsequently, the distance between the mold plates with the blank thus adhesively bonded thereto is expanded while the blank is in the thermoplastic state so as to effect an expansion of the cross-section of the blank with the attendant formation within the expanded cross-section of a plurality of channels separated by the expanded webs of the material in said blank. The channels encompass areas having a partial vacuum therein, and the configuration of each, and of the combination of all, of the channels are in response to the pattern of contact between all of the contacting surfaces.

The channels are vented during the expansion so as to equilibrate the lower level of pressure within the channels with the higher level of ambient pressure without the blank. The uniformity and integrity of the configuration of the resulting cross-sectional geometry is maintained thereby. The expanded blank is thereafter cooled to a temperature below the heat distortion of the material.

As a characteristic feature of the present invention, at least one of the outer surface layers of the expanded blank is then pared to remove relatively higher density material portions from the expanded blank, thereby forming the structural panel of the present invention or a block from which a plurality of such panels may be made in accordance with the present invention.

Preferably, both outer layers of the expanded blank are pared to remove relatively higher density material portions. If appropriately dimensioned, the pared portions may be used as a structural panel in accordance with the invention.

The present invention provides several benefits and advantages.

One benefit of the present invention is that the structural panel of the invention is produced at a lower cost than heretofore known structural panels, as mentioned above. The panel of the invention has a reduced bulk density and, therefore, a lower material cost, without sacrificing needed load-bearing capability.

One of the advantages of the present invention is that the relatively higher density material that is pared from the expanded blank formed by the method of the invention, if not useful as a structural panel in itself, can be recycled and combined with virgin thermoplastic material for forming additional blanks, thereby further reducing material costs.

BRIEF DESCRIPTION OF THE DRAWINGS

In drawings forming a portion of the disclosure of this invention:

FIG. 1 shows a top plan view of the structural panel of the present invention; and FIG. 2 shows a cross-sectional view of the structural panel of the present invention of FIG. 1.

FIG. 3 shows a bottom plan view of the structural panel of the present invention.

DETAILED DESCRIPTION OF THE INVENTION

The present invention is directed to a unitary, structural panel made in one piece of a thermoplastic material and to a method of forming same.

With reference to FIGS. 1, 2 and 3, a preferred embodiment of the structural panel of the present invention is shown. The panel 10 can be of any desired width and length, e.g., four feet by eight feet or five feet by ten feet. Panel 10 also has opposed, substantially parallel faces 12, 14 spaced from one another by a thickness dimension A that usually is in the range of about 1.2 to about 10.2 centimeters.

Panel 10 includes planiform webs 16 of a substantially uniform thickness, within a tolerance or variation of ±0.2 millimeters, that traverse the full thickness dimension A of panel 10. The webs 16 define a plurality of elongated, open channels 18 and a plurality of elongated open channels 19, that may all be of a substantially triangular configuration, that are substantially in axial alignment with one another. The cross-sectional configuration of the channels can be selected by selecting an appropriate configuration for the perforations in the mold plates as is well known in the art. As shown in the FIGURES, channels 18 terminate in a relatively wider aperture at face 12 and channels 19 terminate in a relatively wider aperture at face 14. To maximize compressive strength, the axes of the individual channels preferably are substantially normal to faces 12 and 14. Each of the individual webs 16 also serve as common walls between two contiguous channels 18. The channels 18 are also contiguous to channels 19 and alternatively tape towards faces 12 and 14.

Panel 10 has a bulk density of no more than about 1.1 kilograms per square meter per centimeter of thickness, preferably about 0.38 to about 0.87 kilograms per square meter per centimeter of thickness. The compressive strength of panel 10 in the thickness direction is at least about 7 kilograms per square centimeter, preferably about 7 to about 9 kilograms per square centimeter.

The structural panel of the present invention is formed of a thermoplastic material that is defined as a material that is solid at 25° C. that will soften or flow to a measurable degree above some higher temperature. Exemplary thermoplastic materials useful for the panel of the invention are those described in U.S. Pat. No. 4,148,954, the teachings of which are incorporated herein by reference. High impact polystyrene having a hot tack adhesion temperature of about 70° C. and a Vicat softening temperature of about 100° C. is the preferred thermoplastic material for use in the present invention.

Exemplary alternative methods of forming the structural panel of the present invention from a blank of thermoplastic material, prior to the novel step of paring of at least one of the outer layers of relatively higher density material, are described in U.S. Pat. Nos. 4,148,954, 4,113,909, 3,919,382 and 2,502,304, the teachings of which are incorporated herein by reference.

Thus, in a preferred embodiment of the method of the present invention of forming a unitary, structural panel between a pair of perforated mold plates, the panel is formed from a blank of thermoplastic material so as to provide an expanded cross-sectional geometry. The expanded cross-sectional geometry comprises a plurality of elongated, open channels separated by planiform webs of the thermoplastic material. The surface of each of the perforated mold plates has a non-perforated contacting surface area, the blank has two contacting surfaces, and the thermoplastic material has a hot tack adhesion temperature sufficient to keep the exterior surfaces of the blank in contact with the perforated mold plates as the blank is expanded therebetween.

The method of the invention can be described in a sequence of the following steps:

positioning the two mold plates with respect to each other so that the perforations therein are not aligned, positioning the blank between the perforated surfaces of the mold plates while the blank is heated to a temperature which is greater than or equal to the hot tack adhesion temperature, bringing the mold plates and the blank into contact at the contacting surfaces thereof while the blank is at a temperature of greater than or equal to the hot tack adhesion temperature, so as to effect hot tack adhesion between the contacting surfaces, expanding the distance between the mold plates with the blank thus adhesively bonded thereto and while the blank is in a thermoplastic state so as to effect an expansion of the cross-section of the blank with the attendant formation within the expanded cross-section of a plurality of channels separated by expanded webs of the material in the blank, such channels encompassing areas having a partial vacuum therein, and the configuration of each, and of the combination of all, of the channels being in response to the pattern of contact between all of the contacting surfaces, venting the channels during the expansion so as to equilibrate the lower level of pressure within the channels with the higher level of ambient pressure without the blank and thereby maintain the uniformity and integrity of the configuration of the resulting cross-sectional geometry, cooling the expanded blank to a temperature below the heat distortion temperature of the material, and paring at least one of the outer layers of the expanded blank to remove relatively higher density material therefrom while retaining at least some of the expanded structure, thereby forming the structural panel of the present invention or a block from which a plurality of such panels may be made in accordance with the present invention.

Preferably, both outer layers of the expanded blank may be pared to remove the relatively higher density material therefrom. If appropriately dimensioned, the pared portions may be used as a structural panel in accordance with the present invention.

The pared outer layer or layers consisting of the thermoplastic material of the expanded blank that forms the structural panel of the invention, if not useful as a structural panel in itself or themselves, may be recycled and admixed with virgin thermoplastic material to form blanks by techniques well known in the art. Such blanks can then be utilized to form the structural panels of the invention and thereby minimize material costs.

The paring of the outer layers of the expanded blank may be accomplished by techniques well known in the art, such as through the use of lasers or by hot wire cutting.

The two perforated mold plates used to pull the blank apart can be made of the same or different materials. The mold plates may also be porous or non-porous, planar or non-planar and matching. Exemplary mold plates useful in the method of the invention of forming structural panels are those described in U.S. Pat. Nos. 4,269,586, 4,264,293, and 4,148,954, the teachings of which are incorporated herein by reference.

The foregoing is intended as illustrative of the present invention but not limiting. Numerous variations and modifications may be effected without departing from the true spirit and scope of the invention.

What is claimed is:

1. A unitary, structural panel made in one piece of a thermoplastic material, said panel having width, length, and thickness dimensions and opposed substantially parallel faces spaced from one another by said thickness dimension;

said panel including planiform webs of a substantially uniform thickness that traverse the full thickness dimension of the panel and define a plurality of elongated, open channels that are substantially in axial alignment with one another; and said panel having a bulk density of no more than about 1.1 kilograms per square meter per centimeter of thickness and a compressive strenth in the thickness direction of at least about 7 kilograms per square centimeter.

2. The structural panel of claim 1 wherein said panel has a thickness of from about 1.2 to about 10.2 centimeters.

3. The structural panel of claim 1 or 2 wherein said channels are substantially triangular and taper toward one of said parallel faces.

4. The structural panel of claim 3 wherein said thermoplastic material is high impact polystyrene.

* * * * *